US005096387A

United States Patent [19]

Iio

[11] Patent Number: 5,096,387

[45] Date of Patent: Mar. 17, 1992

[54] VANE COMPRESSOR WITH MEANS FOR OBTAINING SUFFICIENT BACK PRESSURE UPON VANES AT THE START OF COMPRESSOR

[75] Inventor: Masahiro Iio, Saitama, Japan

[73] Assignee: Diesel Kiki Co., Ltd., Tokyo, Japan

[21] Appl. No.: 490,414

[22] Filed: Mar. 8, 1990

[30] Foreign Application Priority Data

Mar. 20, 1989 [JP] Japan ..... 1-68589

[51] Int. Cl.[5] ..... F04C 29/06

[52] U.S. Cl. ..... 417/295

[58] Field of Search ..... 417/295, 310; 418/100

[56] References Cited

U.S. PATENT DOCUMENTS 4,743,183 5/1988 Irie ..... 418/100 X
4,743,184 5/1988 Sumikawa ..... 418/100 X
4,778,352 10/1988 Nakajima ..... 417/295

FOREIGN PATENT DOCUMENTS 107992 8/1981 Japan .
176492 10/1984 Japan .

*Primary Examiner*—Robert G. Nilson
*Attorney, Agent, or Firm*—Charles S. McGuire

[57] ABSTRACT

A vane compressor includes a cylinder having a pair of side blocks. A communication passage is formed through at least one of the side blocks. The communication passage has one end thereof opening into a discharge pressure chamber, and another end thereof opening in a rotor side end face of the at least one of the side blocks at a location corresponding to the orbital path of an end of a back pressure chamber defined in each of vane slits having a vane slidably fitted therein. The communication passage is provided therein with a valve which opens the communication passage when the difference between pressure in the discharge pressure chamber and pressure in the back pressure chamber is below a predetermined value, and closes same when the difference in pressure is above the predetermined valve.

3 Claims, 7 Drawing Sheets

VANE COMPRESSOR WITH MEANS FOR OBTAINING SUFFICIENT BACK PRESSURE UPON VANES AT THE START OF COMPRESSOR

BACKGROUND OF THE INVENTION

This invention relates to a vane compressor for compressing refrigerant circulating through an air-conditioner for automotive vehicles or the like.

Conventionally, a vane compressor of this kind has been disclosed, e.g., by Japanese Provisional Publication (Kokai) No. 59-176492 (Japanese Patent Publication (Kokoku) No. 1-21358), in which, as shown in FIG. 1, each vane back pressure chamber 113*a* communicates with a discharge pressure chamber 110 via an annular groove 134, an internal clearance in a radial roller bearing 109 supporting a driving shaft 120, a through hole 109*b* formed through the outer race of the roller bearing 109, and a passage 136 formed in a side block 102. Arranged in the passage 136 is a valve 141 which opens the passage 136 when the pressure of refrigerant gas within the discharge pressure chamber 110 is lower than a predetermined value, and closes same when the same pressure is higher than the predetermined value.

Even if the centrifugal force acting upon the vane 114 is small and the back pressure within the vane back pressure chamber 113*a* is not high enough at the start of the compressor, the vane 114 retracted within the associated vane slit 113 is projected out of same as the rotor 102 rotates, since refrigerant gas is supplied to the vane back pressure chamber 113*a* via the passage 136, the through hole 109*b*, the internal clearance of the roller bearing 109, and the annular groove 134. Thus, the vane is urged against the inner peripheral surface of a cam ring 101 to start the operation of the compressor without chattering of the vanes and hence occurrence of noise, etc.

Another vane compressor has been disclosed, e.g., by Japanese Provisional Patent Publication (Kokai) No. 56-107992, in which, as shown in FIG. 2, a groove (not shown) opposed to vane back pressure chambers (not shown) is formed in an end face of a side block 151 facing the rotator 161. The vane back pressure chamber communicates with a discharge refrigerant passage 153, through which refrigerant gas compressed by a compression chamber 155 is fed, via a passage 152 formed through the side block 151. Provided in the passage 152 is a valve 154 which opens the passage 152 when a differential pressure between pressure in the discharge refrigerant passage 153 and pressure in the groove is below a predetermined value, and closes same when the differential pressure is above the predetermined value. At the start of the compressor, each vane 157 is easily projected out of the associated vane slit (not shown) since refrigerant gas is introduced into the vane back pressure chamber from the discharge refrigerant passage 153 via the passage 152. Therefore, it is possible to prevent a phenomenon that at the start of the compressor the groove and the vane slits are sealed to hinder the vanes from projecting out of the vane slits.

However, in the vane compressor of FIG. 1, lubricating oil gathered in the roller bearing 109 flows into the passage 136 via the through hole 109*b* to sometimes block same up. On the other hand, in the vane compressor of FIG. 2, lubricating oil introduced into the roller bearing 160 via a passage 158 and a through hole 159 is collected in the groove through a clearance between the side block 151 and the rotor 161. The lubricating oil collected in the groove may flow into the passage 152 to sometimes block same up. If the passages 136, 152 in FIGS. 1 and 2 are blocked up, negative pressure is generated within the vane back pressure chambers at the bottom of the vane slits when the vanes are projected out of the respective vane slits. Therefore, at the start of operation of the compressor, during which the centrifugal force acting upon the vanes is small, the vanes can be hardly projected out of the vane slits to cause chattering of the vanes. Particularly when the outside air temperature is low, this phenomenon occurs frequently. The phenomenon has occurred more frequently due to the use of a lubricating oil having higher viscosity to cope with the recent use of aluminum or an aluminum alloy as the material of the compressor.

SUMMARY OF THE INVENTION

It is the object of the invention to provide a vane compressor which is free from blockade of a passage communicating between the vane back pressure chamber and the discharge pressure chamber by lubricating oil, and hence from chattering of vanes.

To attain the above object, the present invention provides a vane compressor including a cylinder having a pair of side blocks, a rotor rotatably received within the cylinder, the rotor having vane slits, each of the side blocks having an end face facing the rotor, the cylinder and the rotor cooperating to define therebetween at least one compression space for compressing a refrigerant, vanes slidably fitted in the vane slits, respectively, each of the vane slits having a bottom portion cooperating with each of the vanes fitted therein to define a back pressure chamber, and a discharge pressure chamber into which compressed refrigerant is discharged from the compression space.

The vane compressor according to the invention is characterized by comprising:

a communication passage formed through at least one of the side blocks, the communication passage having one end thereof opening into the discharge pressure chamber, and another end thereof opening in the end face of the at least one of the side blocks at a location corresponding to the back pressure chamber; and a valve arranged in the communication passage for opening the communication passage when a difference between pressure within the discharge pressure chamber and pressure within the back pressure chamber is below a predetermined value, and closing same when the difference in pressure is above the predetermined value.

Preferably, the communication passage extends obliquely through the at least one of the side blocks, the one end thereof opening into an upper portion of the discharge pressure chamber.

More preferably, the another end of the communication passage has a circular cross section.

Alternatively, the another end of the communication passage is in the form of a circumferentially elongate it.

Further preferably, the valve comprises a ball valve body received within the communication passage, a valve seat formed in the communication passage, and a spring interposed between the ball valve body and the valve seat and urging the ball valve body in a direction away from the valve seat.

Preferably, the vane compressor includes:

a circumferential groove formed in the end face of the at least one of the side blocks;

the circumferential groove comprising at least one increased diameter portion which extends within a section between a suction stroke-starting position and the vicinity of a compression stroke-ending position and is communicatable with the back pressure chamber of each of the vanes within the section, and at least one reduced diameter portion which extends within a section between the vicinity of the compression stroke-ending position and a discharge stroke-ending position for disconnecting communication between the circumferetial groove and the back pressure chamber of each of the vanes within the second-mentioned section;

and at least one oil feeding port which opens in the end face of the at least one of the side blocks at a location radially outward of the at least one reduced diameter portion for supplying a lubricating oil under high pressure to the circumferetial groove;

wherein the another end of the communication passage is located radially outward of the at least one increased diameter portion.

The above and other objects, features, and advantages of the invention will become more apparent from the ensuiing detailed description taken in conjunction with the accompanying drawings.

DETAILED DESCRIPTION OF THE INVENTION

The invention will now be described in detail with reference to the drawings. FIGS. 3–7 show a vane compressor according to an embodiment of the invention.

Figure 3:
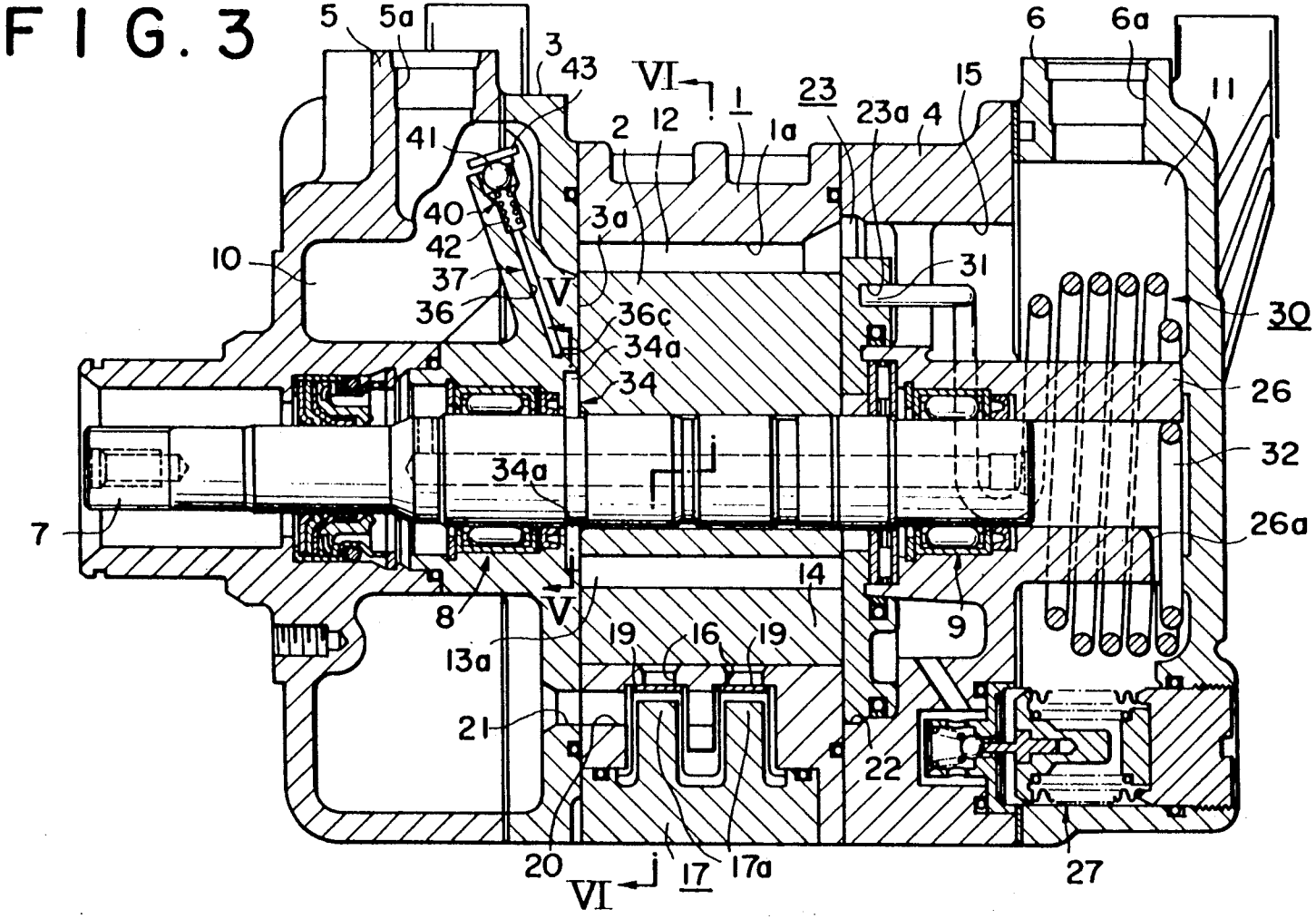
FIG. 3 is a longitudinal cross-sectional view showing a variable capacity vane compressor according to an embodiment of the present invention.
Figure 6:
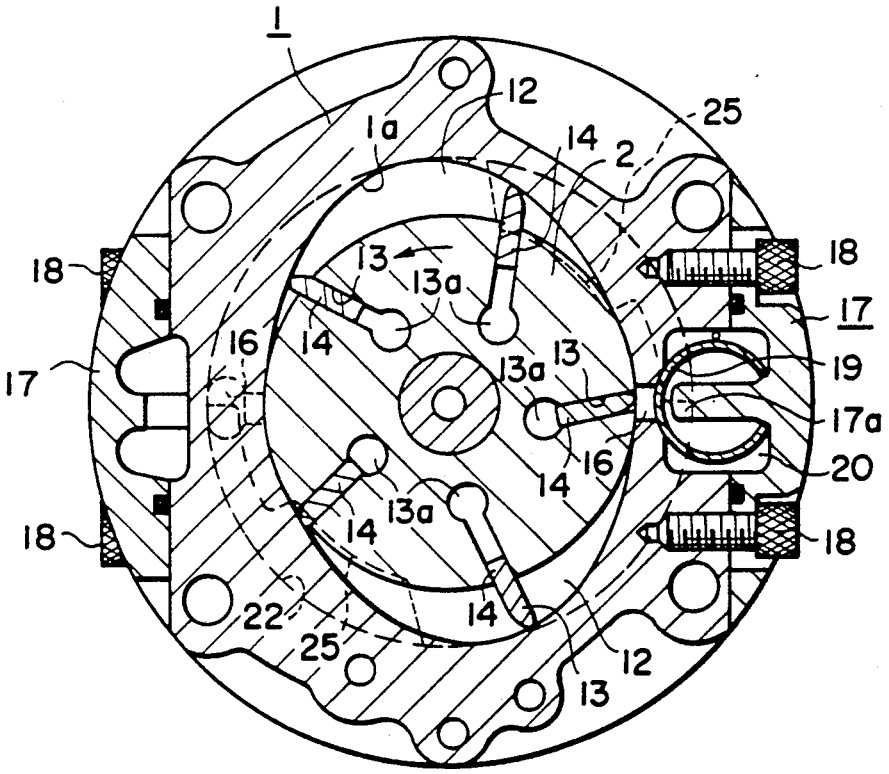
FIG. 6 is a transverse cross-sectional view taken along line VI—VI of FIG. 3, in which a control element is in the maximum capacity position.

Referring to FIGS. 3 and 6, the vane compressor is composed mainly of a cylinder formed by a cam ring 1 having an inner peripheral surface 1*a* with a generally elliptical cross section, and a front side block 3 and a rear side block 4 closing open opposite ends of the cam ring 1, a cylindrical rotor 2 rotatably received within the cylinder, a front head 5 and a rear head 6 secured to outer ends of the respective front and rear side blocks 3 and 4, and a driving shaft 7 on which is secured the rotor 2. The driving shaft 7 is rotatably supported by a pair of radial bearings 8 and 9 provided in the respective side blocks 3 and 4.

A discharge port 5*a* is formed in an upper wall of the front head 5, through which a refrigerant gas is to be discharged as a thermal medium, while a suction port 6*a* is formed in an upper wall of the rear head 6, through which the refrigerant gas is to be drawn into the compressor. The discharge port 5*a* and the suction port 6*a* communicate, respectively, with a discharge pressure chamber 10 defined by the front head 5 and the front side block 3, and a suction chamber II defined by the rear head 6 and the rear side block 4.

A pair of compression spaces 12, 12 are defined at diametrically opposite locations between the inner peripheral surface 1*a* of the cam ring 1, the outer peripheral surface of the rotor 2, an end face of the front side block 3 on the cam ring 1 side, and an end face of a control element 24 on the cam ring 1 side. The rotor 2 has its outer peripheral surface formed therein with a plurality of axial vane slits 13 at circumferentially equal intervals, in each of which a vane 14 is radially slidably fitted. A bottom portion of each vane slit 13 and a corresponding vane 14 cooperate to define a back pressure chamber 13*a* opening at opposite ends thereof in opposite end faces of the rotor 2, and into which is introduced vane back pressure from the compression space 12 through a clearance between one end face of the rotor 2 and a rotor side end face of the front side block 3, and through a clearance between the other end face of the rotor 2 and a rotor side end face of the control element 24.

When the rotor 2 rotates, the tip of the vane 14 slides along the generally elliptical peripheral surface 1*a* of the cam ring 1.

Refrigerant inlet ports 15, 15, only one of which appears in FIG. 3, are formed in the rear side block 4 at diametrically opposite locations (since FIG. 3 shows a cross-section taken at an angle of 90° formed about the longitudinal axis of the compressor, only one of the refrigerant inlet ports is shown in the figure.) These refrigerant inlet ports 15 axially extend through the rear side block 4, and through which the suction chamber 11 and the compression spaces 12 are communicated with each other.

Refrigerant outlet ports 16, 16, each having two openings, are formed through opposite lateral side walls of the cam ring 1 at diametrically opposite locations, as shown in FIG. 6. (In FIG. 3, for the same reason as in the case of the refrigerant inlet ports, only one of the refrigerant outlet ports is shown.) Secured by a bolt 18 to each of the opposite lateral side walls of the cam ring 1 is a discharge valve cover 17 having a valve stopper 17*a*. Interposed between the lateral side wall of the cam ring 1 and the valve stopper 17*a* is a discharge valve 19 which is retained by the discharge valve cover 17. Each discharge valve 19 opens in response to discharge pressure to thereby open the corresponding refrigerant outlet port 16. Further defined by the cam ring 1 and the respective discharge valve covers 17 are a pair of passages 20 which each communicate with a corresponding one of the refrigerant outlet ports 16 when the discharge valve 19 opens. A pair of passages 21 are formed in the front side block 3 at diametrically opposite locations thereof, which each communicate with a corresponding one of the passages 20, whereby when the discharge valve 19 opens to thereby open the refrigerant outlet port 16, a compressed refrigerant gas in the compression space 12 is discharged from the discharge port 5*a* via the refrigerant outlet port 16, the passages 20 and 21, and the discharge pressure chamber 10, in the mentioned order.

Figure 7:
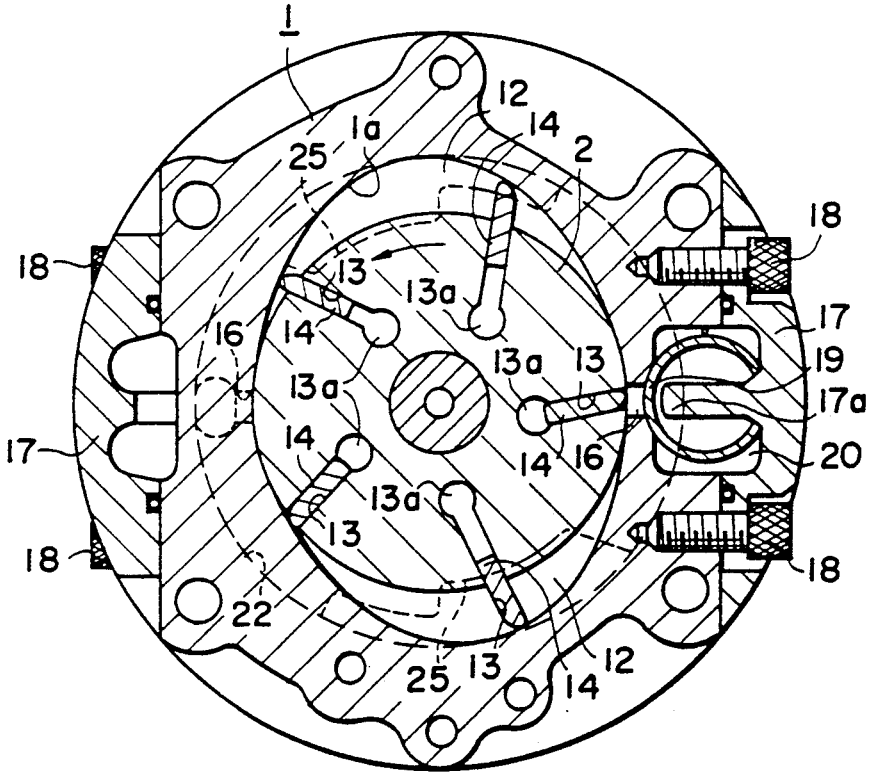
FIG. 7 is a transverse cross-sectional view similar to FIG. 6, in which the control element is in the minimum papacity position

As shown in FIGS. 3 and 6, capacity control means are provided in the rear side block 4, which controls the capacity of the compressor. More specifically, the rear side block 4 has an end face facing the rotor 2, in which is formed an annular recess 22. A control element 23, which is in the form of an annulus, is received in the annular recess 22 for rotation about its own axis in opposite circumferential directions. The control element 23 controls the timing of start of compression of the compressor, and has its outer peripheral edge formed with a pair of diametrically opposite arcuate cut-out portions 25, 26, and its one side surface formed integrally with a pair of diametrically opposite pressure-receiving protuberances (not shown) axially projected therefrom and acting as pressure-receiving elements. Suction pressure Ps, which is low pressure, is applied to one side surface of each pressure-receiving protuberance, and control pressure Pc, which is high pressure produced from discharge pressure Pd introduced via an orifice (not shown), is applied to the other side surface of each pressure-receiving protuberance. The control pressure Pc is controlled by a control valve device 27 such that the suction pressure Ps assumes a predetermined value. Further, the control element 23 is biased by a torsion coiled spring 30 toward the minimum capacity position in which the compression stroke starts at the latest timing as shown in FIG. 7. Thus, the control element 23 is rotatable in opposite directions between the maximum capacity position (shown in FIG. 6) in which the compression stroke starts at the earliest timing and the minimum capacity position (shown in FIG. 7) in which the compression stroke starts at the latest timing in response to the difference between the sum of the suction pressure Ps and the urging force of the coiled spring 30, and the control pressure Pc.

As shown FIG. 3, one end 31 of the torsion coiled spring 30 is fitted in an engaging hole 23*a* formed in the control element 23, while the other end 32 thereof is fitted in an engaging groove 26*a* formed in the end face of a hub 26 integrally projected from the rear side block 4 in a direction away from the rotor 2.

Figure 5:
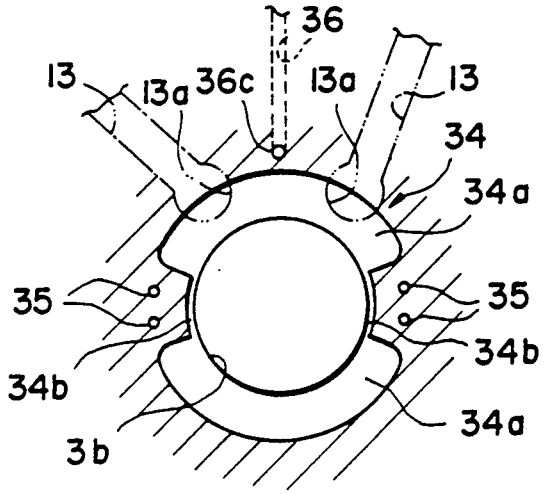
FIG. 5 is a transverse cross-sectional view taken along line V—V of FIG. 3.

As shown in FIGS. 3 and 5, an annular groove (circumferential groove) 34 is formed in the rotor side end face 3*a* of the front side block 3 around a through hole 3*b* thereof through which the diriving shaft 7 extends. The annular groove 34 comprises a pair of increased diameter portions 34*a*, 34*a* which are formed at diametrically opposite locations to communicate with back pressure chambers 13*a* at the bottoms of vane slits 13 receiving vanes 14 located within the section between the suction stroke-starting position and the vicinity of the compression stroke-ending position, and a pair of reduced diameter portions 34*b*, 34*b* which are formed at diametrically opposite locations to disconnect the communication between the annualr groove 34 and vane slits 13 located within the section between the vicinity of the compression stroke-ending position and the discharge stroke-ending position. The two increased diameter portions 34*a*, 34*a* communicate with each other via the reduced diametr portions 34*b*, 34*b*. Formed in the front side block 3 are a pair of oil feeding ports 35, 35 opening in the end face 3*a* at locations radially outward of the respective reduced diameter portions 34*b*, 34*b*. The ports 35, 35 are connected to oil feeding passages (not shown) formed in the front side block 3 so that a lubricating oil under high pressure is supplied by the force of the discharge pressure from an oil sump (not shown) at the bottom of the discharge pressure chamber 10 to the back pressure chambers 13*a* associated with vanes 14 located within the section between the vicinity of the compression stroke-ending position and the discharge stroke-ending position.

Figure 4:
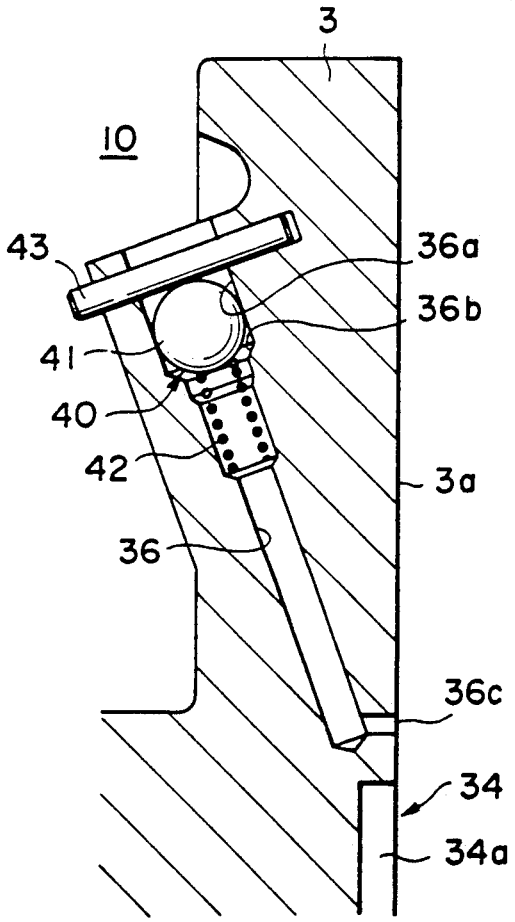
FIG. 4 is a fragementary cross-sectional view showing essential parts of the vane compressor in FIG. 3.

As shown in FIGS. 3 and 4, a communication passage 36 is formed through the front side block 3 for direct communication between the discharge pressure chamber 10 and each back pressure chamber 13*a*. The communication passage 36 obliquely extends through the front side block 3 and has an upper end thereof opening into an upper portion of the discharge pressure chamber 10, while the other or lower end 36*c* thereof opens in the end face 3*a* of the front side block 3, upon which the rotor 2 slides, at a radial location corresponding to the orbital path of the end of the back pressure chamber 13*a*, and radially outward of the increased diameter portions 34*a*, 34*a* of the annular groove 34, as shown in FIG. 5. Arranged in an upper end portion of the communication passage 36 is a valve 40 which operates to open the communication passage 36 when the difference Pd-Pv between the discharge pressure Pd within the discharge pressure chamber 10 and back pressure Pv within the back pressure chamber 13*a* is below a predetermined value, and close same when the difference Pd-Pv is above the predetermined value. The valve 40 comprises, as best shown in FIG. 4, a ball valve body 41 received within an enlarged cylindrical recess 36*a* as a valve bore for displacement between an open position in which the ball valve body 41 is biased away from a valve seat 36*b* formed by a stepped shoulder, as shown in FIG. 4, and a closed position in which the ball valve body 41 is seated on the valve seat 36*b*, a coiled spring 42 interposed between the valve body 41 and the valve slat 36*b* and biasing the ball valve body 41 toward the closed position, and a stopper pin 43 inserted into the front side block 3 transversely of the valve bore 36*a* for holding the ball valve body 41 in the open position.

Next, the operation of this embodient constructed as above will be described.

Figure 1:
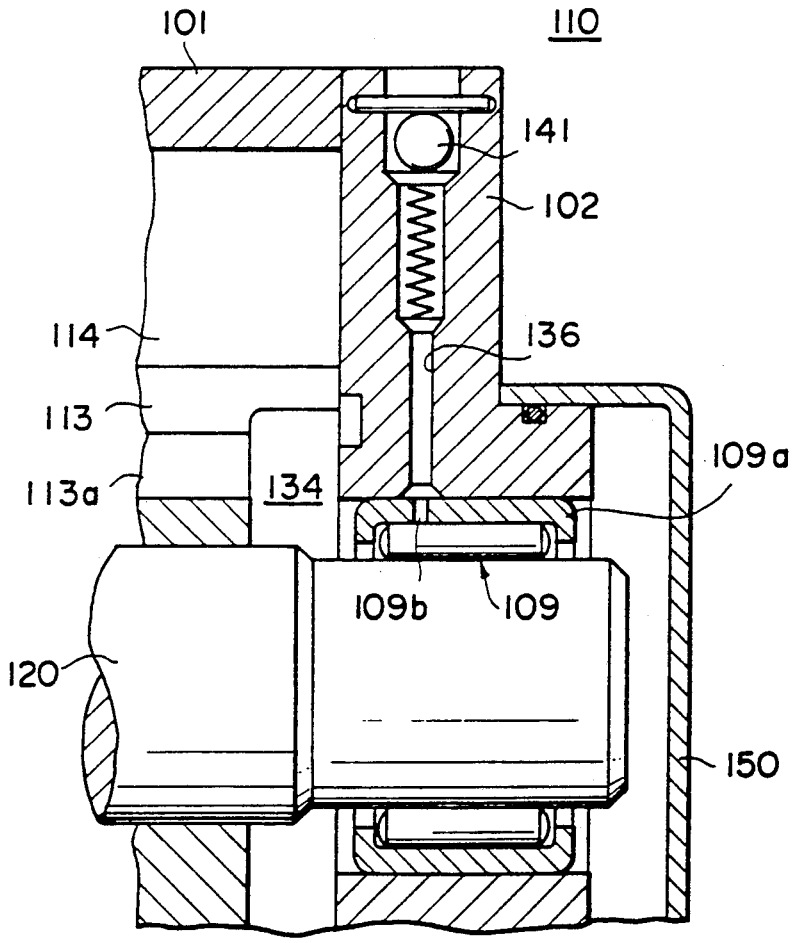
FIG. 1 PRIOR ART
FIG. 1 is a fragmentary longitudinal cross-sectional view showing essential parts of a conventional vane compressor.
Figure 2:
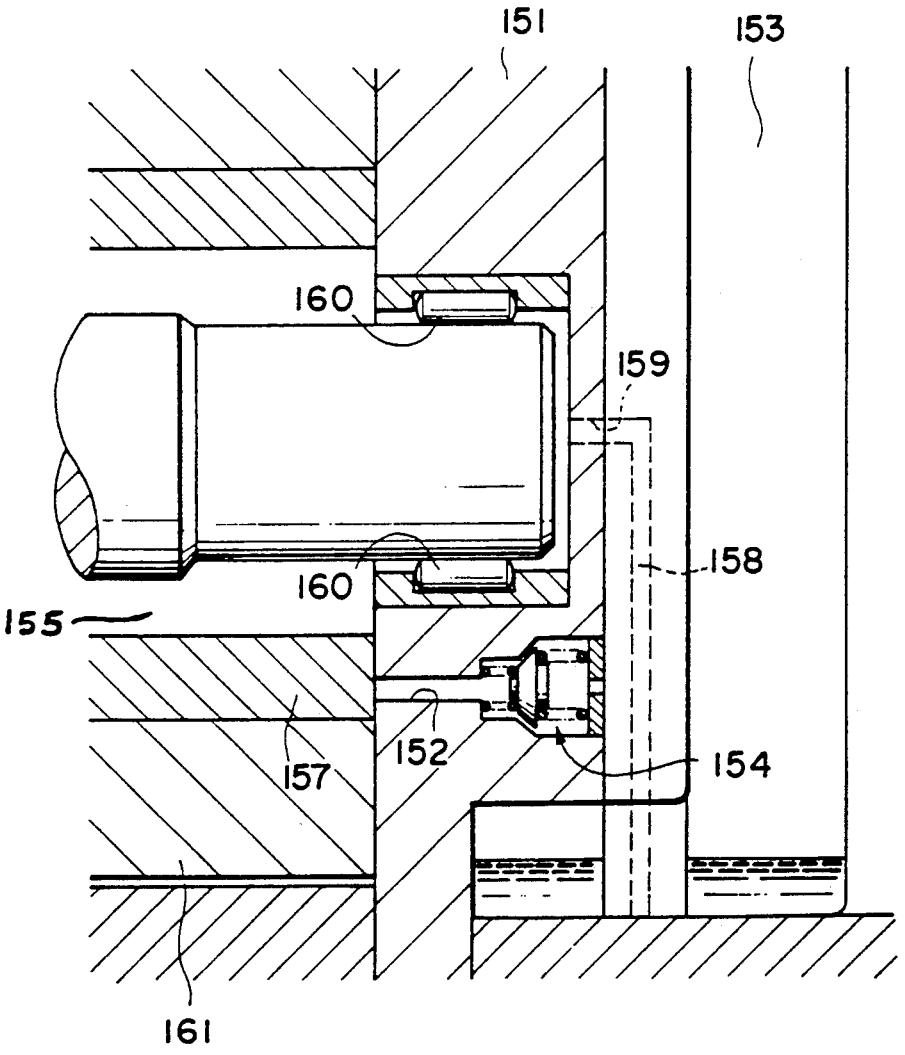
FIG. 2 PRIOR ART
FIG. 2 is a fragmentary longitudinal cross-sectional view showing essential parts of another conventional vane compressor.

At the start of the compressor, when the rotor 2 begins to rotate, lubricating oil under high pressure is supplied by the force of the discharge pressure from the oil sump (not shown) at the bottom of the discharge pressure chamber 10 to the back pressure chambers 13*a* associated with vanes 14 located within the section between the vicinity of the compression stroke-ending position and the discharge stroke-ending position via the oil feeding ports 35, 35. Further, until the difference Pd-Pv between the discharge pressure Pd within the discharge pressure chamber 10 and the back pressure Pv within the back pressure chamber 13*a* reaches the predetermined value, the ball valve body 41 of the valve 40 is biased in the open position as shown in FIG. 2 by the force of the coiled spring 42 to thereby effect direct communication between the discharge pressure chamber 10 and the back pressure chamber 13*a*. Therefore, when the vane 14 is projected out of the associated vane slit 13, no negative pressure is generated within the back pressure chamber 13*a*. As a result, even if the centrifugal force acting upon the vane 14 is still small at the start of the compressor, the vane 14 easily slides out of the vane slit 13, without causing chattering.

When the difference Pd-Pv has reached the predetermined value after the start of the compressor to thereby start normal operation thereof, the ball valve body 41 is displaced downward within the cylindrical recess 36*a* against the biasing force of the coil spring 42 to be seated on the valve seat 36 (i.e. the valve 40 is displaced into the closed position) to thereby close the communication passage 36.

Figure 8:
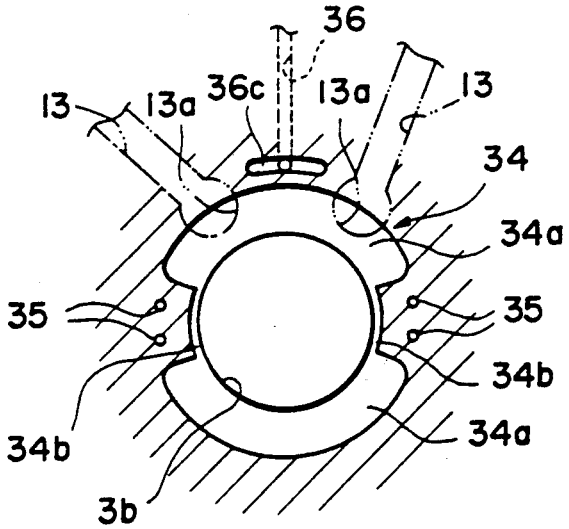
FIG. 8 is a view similar to FIG. 5, showing a variation of the invention.

Although, in the described and illustrated embodiment, the rotor side open end 36c of the communication passage 36 is circular in cross section, this is not limitative, but the same effects as obtained in the above embodiment can be obtained by forming it in the shape of a circumferentially elongate slit as shown in FIG. 8.

Although in the described and illustrated embodiment the passage 36 and the valve 40 are provided in the front side block 3 alone, they may be provided in one or both of the front and rear side blocks 3, 4, each in a similar arrangement to that of the embodiment.

What is claimed is:

1. In a vane compressor including a cylinder having a pair of side blocks, a rotor rotatably received within said cylinder, said rotor having vane slits, each of said side blocks having an end face facing said rotor, said cylinder and said rotor cooperating to define therebetween at least one compression space for compressing a refrigerant, vanes slidably fitted in said vane slits, respectively, each of said vane slits having a bottom portion cooperating with each of said vanes fitted therein to define a back pressure chamber, and a discharge pressure chamber into which compressed refrigerant is discharged from said compression space;

the improvement comprising:

a communication passage formed through at least one of said side blocks, said communication passage having one end thereof opening into said discharge pressure chamber, and another end thereof opening in said end face of said at last one of said side blocks at a location at which said another end communicates directly with said back pressure chamber when said rotor rotates, said another end of said communication passage having a circular cross section; and a valve arranged in said communication passage for opening said communication passage when a difference between pressure within said discharge pressure chamber and pressure within said back pressure chamber is below a predetermined value, and closing same when said difference in pressure is above said predetermined value.

2. In a vane compressor including a cylinder having a pair of side blocks, a rotor rotatably received within said cylinder, said rotor having vane slits, each of said side blocks having an end face facing said rotor, said cylinder and said rotor cooperating to define therebetween at least one compression space for compressing a refrigerant, vanes slidably fitted in said vane slits, respectively, each of said vane slits having a bottom portion cooperating with each of said vanes fitted therein to define a back pressure chamber, and a discharge pressure chamber into which compressed refrigerant is discharged from said compression space;

the improvement comprising:

a communication passage formed through at least one of said side blocks, said communication passage having one end thereof opening into said discharge pressure chamber, and another end thereof opening in said end face of said at least one of said side blocks at a location at which said another end communicates directly with said back pressure chamber when said rotor rotates;

a valve arranged in said communication passage for opening said communication passage when a difference between pressure within said discharge pressure chamber and pressure within said back pressure chamber is below a predetermined value, and closing same when said difference in pressure is above said predetermined value;

a circumferential groove formed in said end face of said at least one of said side blocks;

said circumferential groove comprising at least one increased diameter portion which extends within a section between a suction stroke-starting position and the vicinity of a compression stroke-ending position and is communicatable with said back pressure chamber of each of said vanes within said section, and at least one reduced diameter portion which extends within a section between the vicinity of the compression stroke-ending position and a discharge stroke-ending position for disconnecting communication between said circumferential groove and said back pressure chamber of each of said vanes within said second-mentioned section; and at least one oil feeding port which opens in said end face of said at least one of said side blocks at a location radially outward of said at least one reduced diameter portion for supplying a lubricating oil under high pressure to said circumferential groove;

wherein said another end of said communication passage is located radially outward of said at least one increased diameter portion.

3. In a vane compressor including a cylinder having a pair of side blocks, a rotor rotatably received within said cylinder, said rotor having vane slits, each of said side blocks having an end face facing said rotor, said cylinder and said rotor cooperating to define therebetween at least one compression space for compressing a refrigerant, vanes slidably fitted in said vane slits, respectively, each of said vane slits having a bottom portion cooperating with each of said vanes fitted therein to define a back pressure chamber, and a discharge pressure chamber into which compressed refrigerant is discharged from said compression space;

the improvement comprising:

a communication passage formed through at least one of said side blocks, said communication passage having one end thereof opening into said discharge pressure chamber, and another end thereof opening in said end face of said at least one of said side blocks at a location at which said another end communicates directly with said back pressure chamber when said rotor rotates;

a valve arranged in said communication passage for opening said communication passage when a difference between pressure within said discharge pressure chamber and pressure within said back pressure chamber is below a predetermined value, and closing same when said difference in pressure is above said predetermined value; and an annular groove formed in said end face of said at least one of said side blocks, said back pressure chamber having one end thereof opening in said end face of said at least one of said side blocks, and wherein said another end of said communication passage opens in said end face of said at least one of said side blocks at a radial location corresponding to an orbital path along which said one end of said back pressure chamber moves and radially outward of said annular groove.

* * * * *